US007040212B1

(12) United States Patent
Gaywood et al.

(10) Patent No.: US 7,040,212 B1
(45) Date of Patent: May 9, 2006

(54) LAUNCHING MISSILES

(75) Inventors: John E. Gaywood, Hoddesdon (GB); Ronald Hall, Hitchin (GB)

(73) Assignee: MBDA UK Limited, Hertfordshire (GB)

( * ) Notice: Subject to any disclaimer, the term of this patent is extended or adjusted under 35 U.S.C. 154(b) by 1826 days.

(21) Appl. No.: 08/693,788

(22) Filed: Aug. 9, 1996

(51) Int. Cl.
*F41F 3/042* (2006.01)

(52) U.S. Cl. ..... 89/1.801; 89/1.816; 89/1.817

(58) Field of Classification Search ..... 89/1.801, 89/1.809, 1.81, 1.816, 1.817, 1.819
See application file for complete search history.

(56) References Cited

U.S. PATENT DOCUMENTS

| | | | | | |
|---|---|---|---|---|---|
| 2,802,399 | A | | 8/1957 | Little | |
| 2,903,124 | A | * | 9/1959 | Carver | 89/1.819 |
| 3,014,410 | A | | 12/1961 | Anderson | |
| 3,135,163 | A | | 6/1964 | Mechlin et al. | |
| 3,769,876 | A | * | 11/1973 | Hass et al. | 89/1.816 |
| 4,498,368 | A | * | 2/1985 | Doane | 89/1.817 |
| 4,934,241 | A | * | 6/1990 | Piesik | 89/1.817 |
| 5,012,718 | A | * | 5/1991 | Miller | 89/1.816 |
| 5,194,688 | A | * | 3/1993 | Piesik | 89/1.816 |
| 5,239,909 | A | * | 8/1993 | Bell et al. | 89/1.816 |
| 5,322,002 | A | * | 6/1994 | Miskelly, Jr. et al. | 89/1.816 |

FOREIGN PATENT DOCUMENTS

| | | |
|---|---|---|
| EP | 0 473 498 | 3/1992 |
| FR | 2 555 725 | 5/1985 |
| GB | 1267679 | 5/1968 |
| GB | 1575044 | 9/1980 |
| GB | 2142741 B | 2/1984 |
| GB | 2 140 898 | 12/1984 |
| GB | 2145203 A | 3/1985 |

* cited by examiner

*Primary Examiner*—Michael J. Carone
(74) *Attorney, Agent, or Firm*—Nixon & Vanderhye P.C.

(57) ABSTRACT

A container (1) for acting as a storage enclosure and launch tube for a missile (3), the container (1) comprising an integral missile efflux management system including an efflux deflector (1*d*) positioned for receiving the missile efflux and deflecting it into a series of ducts (8) which run alongside the missile to the missile exit end (16) of the container (1), which end may have an openable cover (7) operable to close both the missile exit and the exits from the ducts (8). The efflux deflector is a dome-shaped base-plate (1*d*) spaced from the ducts to define a plenum chamber. The particular interior shape of the base plate (1*d*) ensures optimum efflux management.

5 Claims, 4 Drawing Sheets

LAUNCHING MISSILES

The invention relates to "containerised" missile systems in which one or more missiles are supplied in and launched from a respective container or box, the container being adapted both for storage of the missile and to act as a missile launcher which redirects the missile motor efflux in the direction of launch. Such systems give a degree of versatility in that a land vehicle, ground station or ship, for example, can be relatively easily adapted to carry one or several of the containers. Generally, the containers are mounted to launch the missiles vertically but this is not essential. Also, for compactness, it may be desirable to store the containers horizontally, e.g. in a stack on or below a ship's deck.

A number of design difficulties associated with such systems concern the management of the efflux from the missile when it is fired. It is known for the mounting arrangement for a battery of containers to include a common plenum chamber and exit stack(s) with which the containers are able to communicate. This adds to the complexity of the mounting arrangement and possibly also the containers, since each must be provided with an openable door or the like to prevent interference with one missile by the efflux of another which has been fired.

The present invention aims to provide a container having improved efflux management compared with known systems.

Accordingly, the invention comprises a container for housing a missile and for having the missile fired therefrom, the container incorporating an integral efflux management system including duct means, deflector means for directing the missile efflux into the duct means, and closure means for maintaining the container normally closed while ensuring, on firing of the missile, that the duct means becomes open to allow exit of said efflux, in which the deflector means comprises a base-plate which is separated from said duct means and whose interior wall is so shaped to define therebetween a chamber having the shape of a flattened dome.

By way of example, the container can comprise an elongate box along the interior surface of which run ducts leading from the chamber located behind the missile, to the exit end of the container, which exit end is closed by a cover openable to allow exit of the missile from the container and the efflux from said ducts.

The purpose of the specially-shaped base plate is to ensure efficient missile efflux management. Compared with a true domed or hemispherical shape, the flattened shape of the chamber also allows a reduced container length without sacrificing efficiency.

The inventors have found that base plate pressures are very sensitive to chamber depth (i.e. missile nozzle exit to base plate separation). It is preferable for this dimension to be optimised for a given missile boost motor, in order to give acceptable base plate pressures while minimising container length.

The interior wall of the base-plate is rounded in order to ensure smooth, steady flow of efflux throughout the ducts and chamber, thereby preventing the occurrence of unstable corner vortices. Such vortices can periodically break away along the ducts, resulting in undesirable pressure pulses.

Preferably, the interior wall of the base plate is lined with an ablative coating.

The container could be of any convenient cross-sectional shape, for example, circular, square or rectangular, and could contain any number of ducts, as convenient.

At the missile exit end of the container, the ducts could be flared outwards, or deflector members could be provided, to deflect the missile efflux outwardly away from the container's longitudinal axis and hence away from the missile's flight path.

The closure means preferably comprises an inner frangible cover and an outer rough-handling cover. Alternatively, the outer cover could comprise a hinged door coupled to a pneumatic, hydraulic, spring-operated or pyrotechnic opening device and held closed by a releasable catch.

The container may be designed for single-shot operation or made more durable so that, with some refurbishment, it can be used a number of times.

Various known safety devices may be incorporated in the container, for example a water deluge mechanism.

Optionally, a valve, suitably located, could be provided for enabling nitrogen filling and gas pressure measurement.

An embodiment of the invention will now be described, by way of example only, with reference to the drawings, of which:

Figure 1:
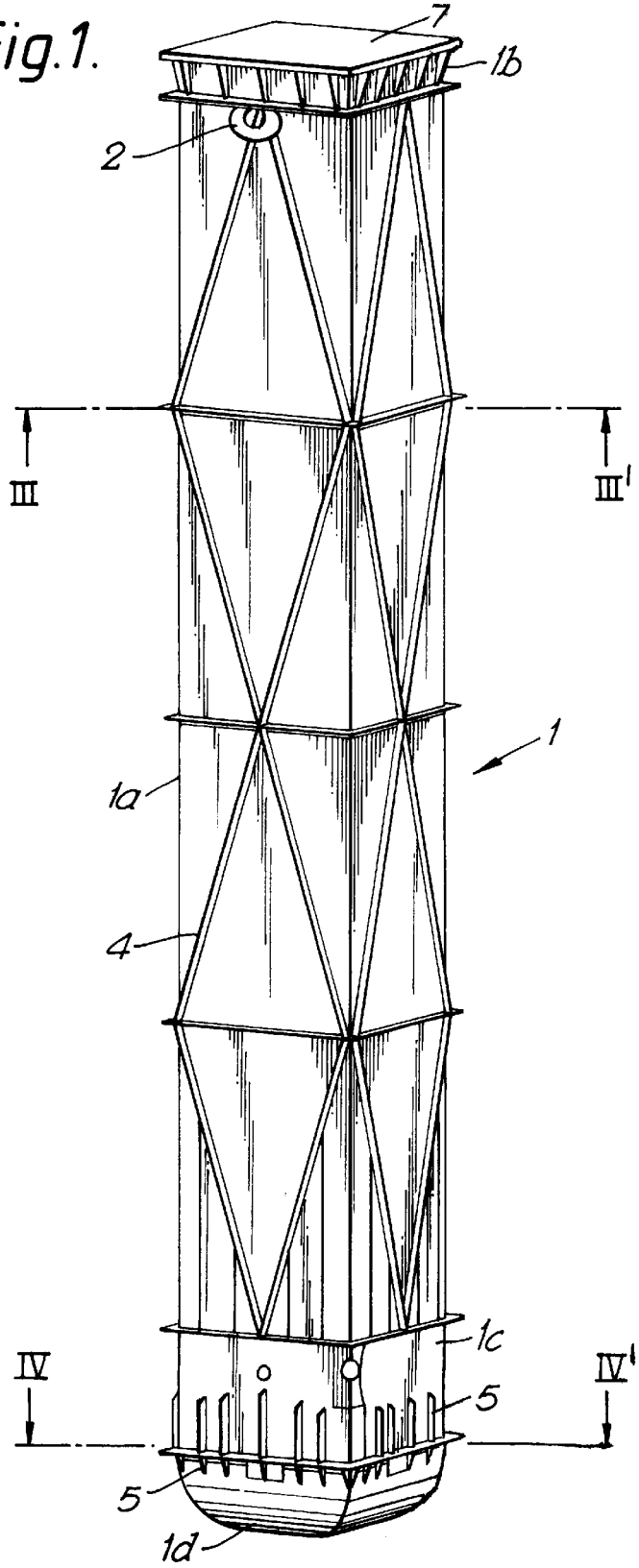
FIG. 1 is a perspective view of a container in accordance with the invention.
Figure 2:
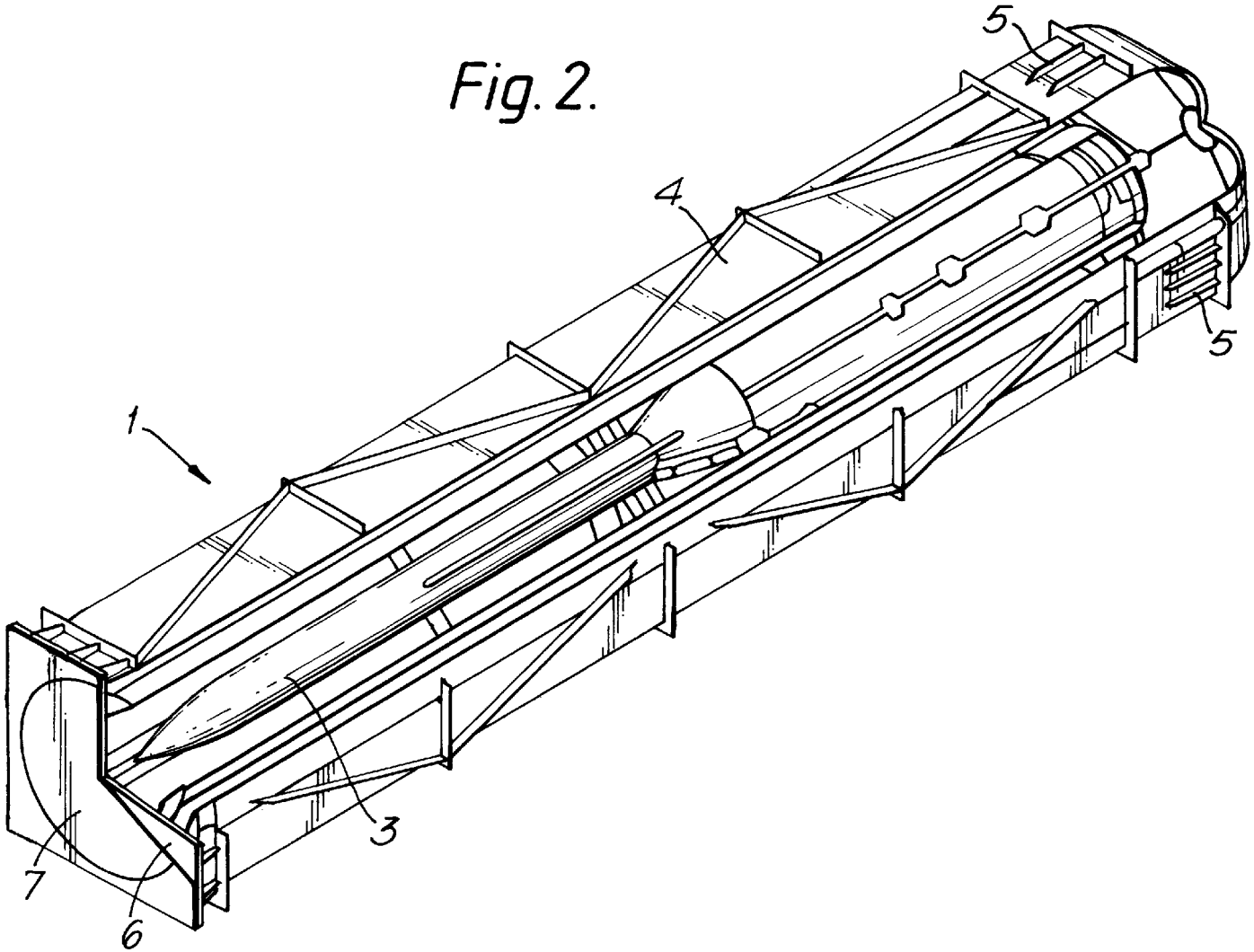
FIG. 2 is a part cutaway perspective view of the container of FIG. 1.

The container 1 shown in FIGS. 1 and 2 is generally of square cross-section and is composed of four sections; viz. a duct section 1*a* which terminates in a diffuser 1*b*, a pedestal section 1*c* and a base plate 1*d*. The container 1 may be made of plastics material, metal or any other suitable material or it may comprise a combination of such materials. The container wall may be such as to provide a degree of armour protection to its contents or it may be only partly armoured, say on one side thereof which, in use, faces most likelihood of damage.

Lifting lugs 2 fitted at one end may be arranged to give the subsidiary function of preventing the container 1 from rolling about when laid on the deck of a ship say, perhaps in a stack along with many other such containers. The container 1 may be mounted in more than one position from which firing of the missile may take place. This position could be with its axis vertical, horizontal or included in which case some suitable vertical or inclined fixing member is provided. The fixed mounting for the container might also comprise some form of cradle and such a cradle might allow for variation of the container axis direction.

Within the container 1 is a missile 3.

Strengthening frames 4 extend the length of the duct section 1*a* and strengthening ribs 5 are provided on the pedestal section 1*c* and base plate 1*d*.

The diffuser 1*b* is flared outwards in order to deflect missile efflux away from the missile's flight path.

The container is sealed, (at the diffuser end) by an inner frangible cover 6 and, covering this cover 6, an outer rough-handling cover 7. The cover 7 is intended to be removed manually say when the container 1 has been set-up in its position of use and/or at times when it is likely to be needed. The inner frangible cover 6 is burst or blown off just prior to missile firing by say a pyrotechnic rupture device. However, both covers are designed to allow for the possibility of inadvertent firing of the missile while it is held within the container. Being frangible, the cover 6 would be burst by the resultant gas pressure while the cover 7 could be so held in place that it also is ejected by the gas pressure.

The back or tail of the missile 3 lies at a position spaced from the other end of the container, which end is closed by the base plate 1*d*.

Figure 3:
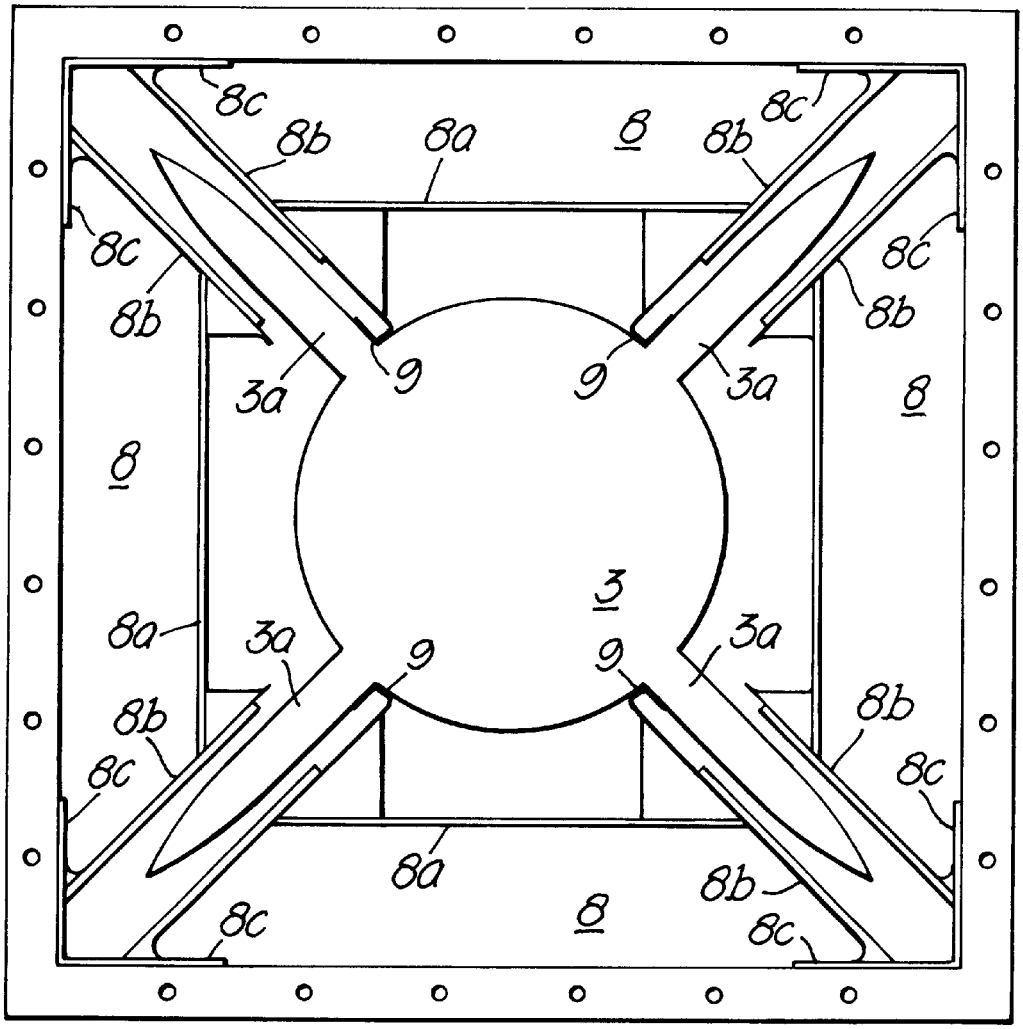
FIG. 3 is a section on the line III—III' of FIG. 1.

Referring now to FIG. 3, the interior of the container 1 is partitioned to receive the missile 3 and its four fins 3*a* and to define four equi-spaced, peripheral ducts 8 running the length of the duct section 1*a*.

Each duct 8 is defined by a base wall 8*a* running parallel to and distanced from the container wall, and two side walls 8*b* which extend from respective edges of the base walls 8*a*. The distance between a pair of side walls 8*b* becomes greater with the distance from the base wall 8*a*. Each side wall 8*b* terminates in an outwardly-turned flange 8*c* which is fixed to the container wall. A base wall 8*a* of a respective duct 8 faces the base wall 8*a* of an opposite duct 8 and is spaced therefrom.

The missile is positioned in the space bounded by the four base walls 8*a* of the four ducts with its fins 3*a* extending between facing side walls 8*b* of adjacent ducts 8.

The container/missile arrangement can be assembled by locating the missile 3 within the pedestal section 1*c*, placing the duct section 1*a* over the missile 3 and making necessary connections to the pedestal section, and finally bolting on the 1*d* base plate to the pedestal section 1*c*.

Figure 4:
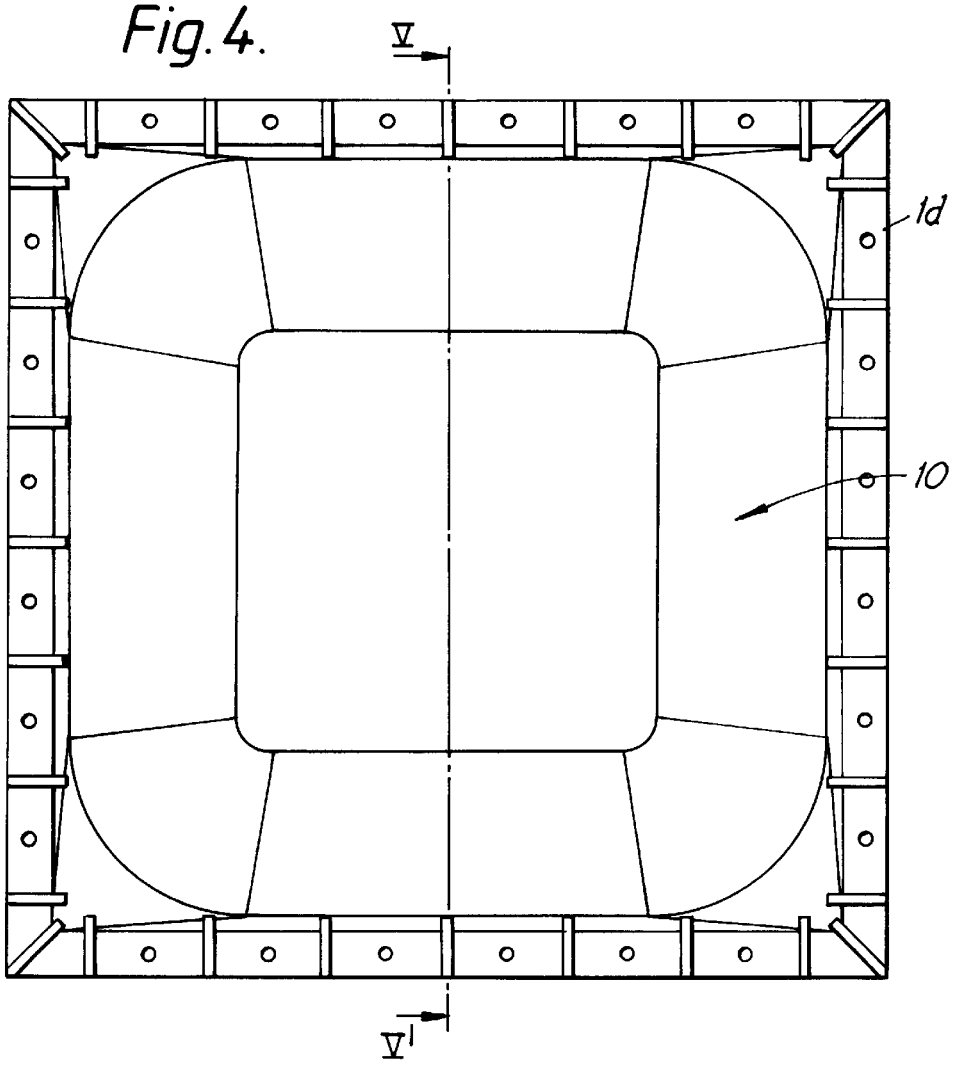
FIG. 4 is a section on the line IV—IV' of FIG. 1.
Figure 5:
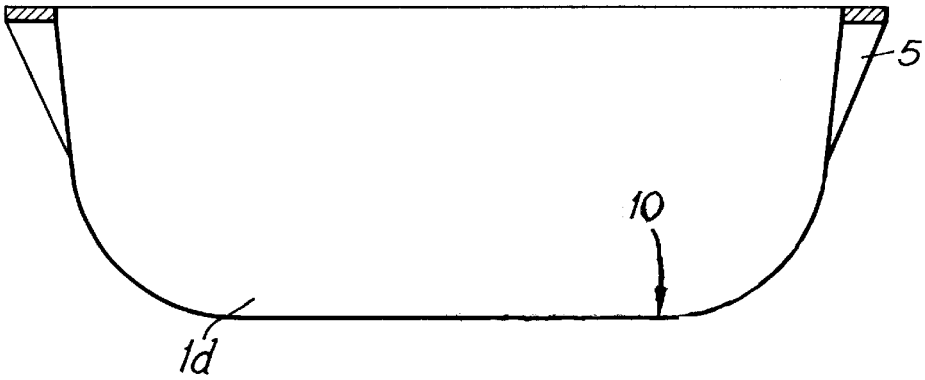
FIG. 5 is a section on the line V—V' of FIG. 4.

The base plate 1*d* which is shown in plan and cross-section in FIGS. 4 and 5 respectively has an inner wall 10 shaped so that a chamber having the shape of a flattened dome is defined between said inner wall and the ducts 8.

The function of the inner wall 10 is to deflect the missile efflux through 180°, back in the direction from which it arrived and into the ducts 8. The ducts 8 lead the efflux out of the container at the top i.e. in the same direction as the missile emerges. A protective coating of ablative (not shown) material may be applied to all or selected parts of the exposed surfaces of the ducts 9 and/or the inner wall 10.

During launch, the missile boost motor jet efflux is directed at the inner wall 10 of the base-plate 1*d*. The inner wall 10, which reverses the direction of the efflux is therefore subjected to a total force equally to twice the thrust of the motor. The strengthening ribs 5 provided on the outer wall of the base-plate 1*d* serve to limit any resulting distortion of the base-plate and possible separation of the ablative coating.

What is claimed is:

1. A container for housing a missile for transport and storage of the missile and for having the missile fired therefrom, said container having internal wall means which separate the interior thereof into an elongate missile receiving space and one or more elongate missile efflux receiving ducts extending alongside the missile receiving space, efflux deflector means for receiving the missile efflux from one end of the missile receiving space and directing it into the adjacent end of the or each efflux receiving duct, and closure means for maintaining said container normally closed and for becoming open, on firing of the missile, to permit exit of the missile from the other end of said missile receiving space and to permit exit of the missile efflux from the other end of the or each duct, in which said efflux deflector means comprises a base-plate having an interior wall having the shape of a flattened dome.

2. A container as claimed in claim 1 in which efflux deflector members are provided at the missile exit end of said ducts.

3. A container as claimed in claim 1 in which said closure means comprise an inner frangible cover and an outer releasable cover.

4. A container as claimed in claim 1 in which the outer wall of said base plate incorporates strengthening ribs.

5. A container as claimed in claim 1 in which the interior wall of said base plate has an ablative coating.

* * * * *